US010974922B2

(12) United States Patent
Enomoto

(10) Patent No.: US 10,974,922 B2
(45) Date of Patent: Apr. 13, 2021

(54) SHEET PRESSING APPARATUS AND IMAGE FORMING SYSTEM HAVING THE SAME

(71) Applicant: Shinnosuke Enomoto, Yamanashi-ken (JP)

(72) Inventor: Shinnosuke Enomoto, Yamanashi-ken (JP)

(73) Assignee: CANON FINETECH NISCA INC., Misato (JP)

( * ) Notice: Subject to any disclaimer, the term of this patent is extended or adjusted under 35 U.S.C. 154(b) by 0 days.

(21) Appl. No.: 16/707,791

(22) Filed: Dec. 9, 2019

(65) Prior Publication Data

US 2020/0180898 A1 Jun. 11, 2020

(30) Foreign Application Priority Data

Dec. 10, 2018 (JP) ..... JP2018-230531

(51) Int. Cl.
*B65H 37/06* (2006.01)
*B65H 45/18* (2006.01)
*B65H 45/30* (2006.01)

(52) U.S. Cl.
CPC ..... *B65H 45/18* (2013.01); *B65H 37/06* (2013.01); *B65H 45/30* (2013.01);
(Continued)

(58) Field of Classification Search
CPC ..... G03G 2215/00877; B31F 1/0006; B31F 1/0035; B65H 45/18; B65H 45/30; B65H 37/06; B65H 2301/4505; B65H 2301/51232; B65H 2801/27; B65H 2701/13212
See application file for complete search history.

(56) References Cited

U.S. PATENT DOCUMENTS 6,905,118 B2 * 6/2005 Yamada ..... B65H 45/18 270/8
7,431,274 B2 * 10/2008 Kushida ..... B65H 37/06 270/37

(Continued)

FOREIGN PATENT DOCUMENTS

JP 2012-153525 A 8/2012
JP 2012-171727 A 9/2012

*Primary Examiner* — Leslie A Nicholson, III
(74) *Attorney, Agent, or Firm* — Manabu Kanesaka

(57) ABSTRACT

The sheet pressing apparatus includes an inlet port configured to receive a sheet having a folding line; additional-folding rollers arranged downstream of the inlet port and configured to press the sheet at the folding line; a lower folding guide opposing the additional-folding rollers; a first drive mechanism configured to move the additional-folding rollers between a pressing position, at which the additional-folding rollers approach the lower folding guide to press the sheet at the folding line, and a retreat position to which the additional-folding rollers are moved with respect to the lower folding guide from the pressing position; a second drive mechanism configured to move the additional-folding rollers along the folding line; and a restriction member configured to restrict, at a preset restriction position, the sheet thickness at the folding line to a value equal to or less than a prescribe value, while the additional-folding rollers are moving.

9 Claims, 7 Drawing Sheets

(52) U.S. Cl.
CPC ..... *B65H 2301/4505* (2013.01); *B65H 2701/13212* (2013.01); *B65H 2801/27* (2013.01); *G03G 2215/00877* (2013.01)

(56) References Cited

U.S. PATENT DOCUMENTS

| | | | | |
|---|---|---|---|---|
| 8,251,359 | B2 * | 8/2012 | Suzuki | B65H 45/18 270/45 |
| 8,459,630 | B2 * | 6/2013 | Watanabe | B65H 45/18 270/45 |
| 8,459,631 | B2 * | 6/2013 | Ishikawa | B42B 4/00 270/51 |
| 9,688,503 | B2 * | 6/2017 | Fukasawa | B65H 45/18 |
| 9,932,199 | B2 * | 4/2018 | Katsumata | B65H 45/18 |
| 10,625,971 | B2 * | 4/2020 | Horiguchi | G03G 15/6541 |

* cited by examiner

SHEET PRESSING APPARATUS AND IMAGE FORMING SYSTEM HAVING THE SAME

CROSS-REFERENCE TO RELATED APPLICATION

The present application is based on and claims priority of Japanese Patent Application No. 2018-230531 filed on Dec. 10, 2018, the disclosure of which is incorporated herein.

BACKGROUND OF THE INVENTION

Field of the Invention

The present invention relates to a sheet pressing apparatus designed to fold a sheet, and to an image forming system having the sheet pressing apparatus, such as a copier, a printer, a facsimile apparatus, and a composite machine composed of these.

Background Art

Various sheet folding apparatuses (post-process apparatuses) are known, for use in image forming systems such as copiers and printers. Of these sheet folding apparatuses, an apparatus is known, which first folds a sheet, forming a folding line, and then folds the sheet further (namely, performing an additional folding) using another pressing member in order to prevent the thickness (i.e., folding height) of the folded part of the sheet from increasing.

JP 2012-153525 A, for example, discloses a sheet processing apparatus which comprises a folding-roller pair for performing a folding process on sheets and an additional-folding mechanism arranged downstream from the folding-roller pair and composed of a plurality of roller pairs extending parallel to the folding-roller pair, and in which additional folding is performed by continuously applying loads, using the plurality of rollers, to the folding part (folding line) of the sheet, without increasing the processing time.

JP 2012-171727 A discloses a sheet folding apparatus for folding sheets. In this apparatus, the sheets continuously transported in a transport path are folded, any sheet folded is temporarily stuck in another transport path, and the sheet so stuck and any following sheet are transported to an additional-folding section after they are folded, and an additional-pressing roller is moved in a direction intersecting with the sheet transporting direction, thereby pressing the folded parts of both overlapped sheets again (along the folding line).

In the sheet processing apparatus disclosed in JP 2012-153525 A, a plurality of roller pairs are provided, the roller pairs of the additional-folding mechanism are arranged parallel to the folding rollers. Therefore, the folding line of the sheet and the axes of the additional-folding rollers extend in the same direction. The sheet filament at the folding line are inevitably collapsed. In view of this, the sheet folding effect is smaller than that obtained by the method of additionally folding sheets by moving additional-pressing means such as rollers, along a folding line.

In the sheet folding apparatus disclosed in JP 2012-171727 A, the additional-pressing roller is moved along the folding line of the sheet, from one end to the other end thereof, thereby accomplishing the additional folding. Therefore, if the sheet rises at both ends along the folding line, or if the first folding is insufficient and the sheet halves therefore are greatly spaced in the vertical direction, the additional-pressing roller will probably damage the sheet at one end. Further, if the distance between the sheet halves bordering at the folding line is long in the vertical direction, the reaction of the sheet will increase, failing to apply a sufficient pressure at the folding line. Consequently, the sheet may not be folded sufficiently.

SUMMARY OF THE INVENTION

In view of the above, the object of this invention is to apply a sufficient pressure to a sheet along a folding line, strengthening the folded part of the sheet as well as reducing damage to the sheet, thereby to solve the problems with the prior art.

To achieve the above-mentioned object, a first embodiment of the embodiment of this invention is a sheet pressing apparatus configured to perform an additional folding on a sheet already folded and therefore having a folding line. The sheet pressing apparatus comprises: an inlet port configured to receive a sheet having a folding line made in a folding process and transported in a prescribed transport direction; a first pressing member arranged downstream of the inlet port, as viewed in the transport direction, and configured to press the sheet at the folding line; a second pressing member arranged, opposing the first pressing member, and configured to cooperate with the first pressing member to press the sheet at the folding line; a first drive mechanism configured to move the first pressing member between a pressing position and a retreat position, thereby to cause the first pressing member to approach the second pressing member and, at the pressing position, to press the sheet at the folding line arranged between the first pressing member and the second pressing member, and to cause the first pressing member, at the retreat position, to move away from the sheet with respect to the second pressing member; a second drive mechanism configured to move the first pressing member along the folding line with respect to the second pressing member, after the first drive mechanism moves the first pressing member to the pressing position with respect to the second pressing member; and a restriction member configured to restrict, at a preset restriction position, the sheet thickness at the folding line to a value equal to or less than a prescribe value when the second drive mechanism starts moving the first pressing member at the pressing position along the folding line with respect to the second pressing member.

In the sheet pressing apparatus described above, the folding line made on the sheet transported to it is arranged between the first and second pressing members. Then, the first pressing member is moved on the second pressing member along the folding line, thereby performing the additional folding at the folding position. Further, since the restriction member restricts the sheet thickness at the folding line to a value equal to or less than a prescribe value when the first pressing member moves along the folding line with respect to the second pressing member, the first pressing member can be prevented from interfering with either end of the folding line, and would not damage the sheet while it is moving along the folding line. Further, since, when the first and second pressing members press the sheet along the folding line, the restriction member restricts the thickness of the folded part of the sheet to a value equal to or less than a preset value, the distance between the edges of the sheet, across the folding line, is short. The reaction that the sheet applies to the first and second pressing members therefore becomes small. As a result, a higher pressure can be applied at the folding line to strengthen the sheet sufficiently at the folding line.

Preferably, the sheet pressing apparatus may further comprise a pair of transport guides which are arranged upstream from the restriction member in the transport direction, spaced apart by a first distance, opposing each other, and which are configured to restrict the position of the sheet in the sheet thickness direction. Further, the restriction member at the restriction position should preferably be set at a second distance equal to or shorter than the first distance in the sheet thickness direction. If the sheet pressing apparatus is so configured, the sheet is less restricted, in terms of thickness at the folding line, when the restriction member is arranged at the restriction position, than when the sheet passes through the nip of the transport guides. Therefore, the restriction member performs its function reliably.

It is desirable that when the sheet is transported toward the nip between the first and second pressing members through the pair of transport guides, the restriction member should be arranged at a sheet-receiving position spaced from the second pressing member in the sheet thickness direction by a third distance longer than the second distance and restricts the sheet thickness at the folding line. If the sheet pressing apparatus is so configured, the folding line of the sheet can be positioned between the first and second pressing members while the restriction member remains more remote from the second pressing member than from the restriction position. The restriction member does not interfere with the transported sheet, and can function as a guide and can restrict the sheet thickness at the folding line.

It is desirable that the sheet pressing apparatus should further comprise a biasing member configured to bias at least one of the first and second pressing members toward the folding line. This configuration can absorb the change in the sheet thickness at the folding line.

The sheet pressing apparatus of the configuration described above may further comprise a support member and a plurality of biasing members. The support member supports a plurality of first pressing members spaced apart from one another. The biasing members are provided for the first pressing members, respectively, and bias the first pressing members, respectively, toward the folding line. Since the first pressing members are biased individually toward the folding line, the difference between the pressing forces the first pressing members apply to the folding line can be controlled.

In another embodiment of the invention, the first drive mechanism may move the restriction member together with the first pressing member In still another embodiment of the invention, the second drive mechanism may drive the restriction member moved to the restriction position by the first drive mechanism, along the folding line together with the first pressing member.

The restriction member may be arranged to restrict, at the restriction position, before moving the first pressing member along the folding line, that part of the sheet which is upstream of the folding line in the direction the first pressing member moves. In this case, a plurality of first pressing members are provided, arranged along the folding line, and the restriction member is arranged between adjacent any two first pressing members.

Further, this invention provides an image forming system which comprises: an image forming apparatus configured to form an image on a sheet; a sheet processing apparatus configured to fold the sheet delivered from the image forming apparatus; and a sheet pressing apparatus of the type described above.

In this invention, while the first pressing member is moving along a folding line with respect to the second pressing member, the restriction member restricts the thickness of the folded part of a sheet to a value equal to or less than a preset value. The first pressing member can therefore be prevented from interfering with either end of the folding line, and would not damage the sheet while it is moving along the folding line for additional folding. Further, since the restriction member restricts the thickness of the folded part of a sheet to a value equal to or less than a preset value, the distance between the edges of the sheet becomes short, and the reaction applied from the sheet to the first and second pressing members decreases. A higher pressure can therefore be applied at the folding line, allowing the sheet to be folded more firmly.

BRIEF DESCRIPTION OF THE DRAWINGS

FIG. 4A showing a sheet stopped with its folding line located below the additional-folding rollers, and FIG. 4B showing the sheet pressed by the additional-folding rollers, undergoing the additional folding;

DETAILED DESCRIPTION OF THE PREFERRED EMBODIMENTS

Figure 1:
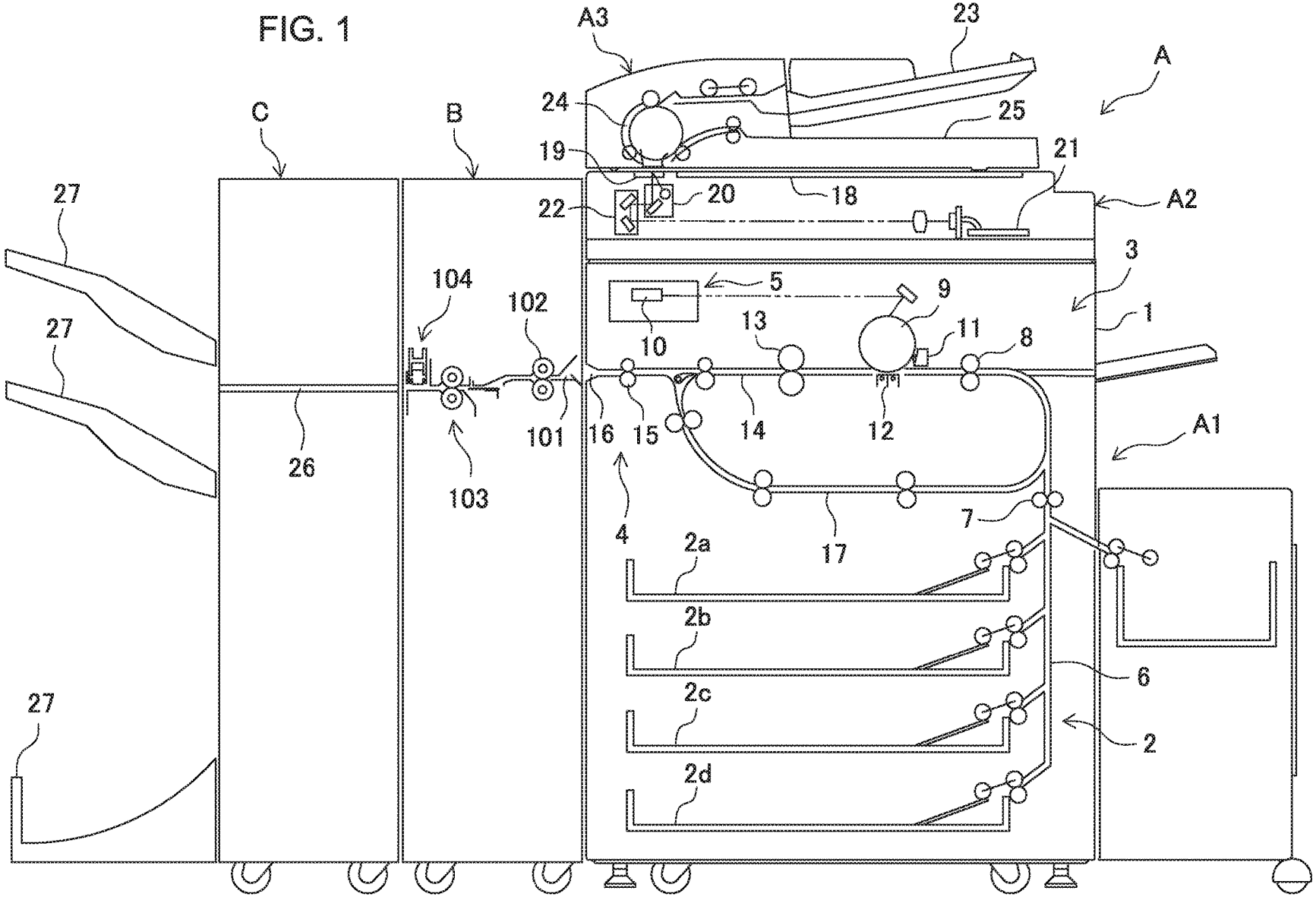
FIG. 1 is a diagram showing the overall configuration of an image forming system having a sheet pressing apparatus according to the present invention.

A preferred embodiment of this invention will be described with reference to the drawings attached hereto. In the drawing, the similar components are designated by similar reference numbers.

First, an image forming system incorporating a folding process apparatus having an additional-folding unit, i.e., sheet pressing apparatus according to this invention, will be described with reference to FIG. 1. The image forming system is composed of an image forming apparatus A, a folding process apparatus B, and a post-process apparatus C. The image forming apparatus A forms an image on a sheet S, and the folding process apparatus B performs a folding process on the sheet S. The post-process apparatus C, which is located downstream, performs a stapling process or a sheet-registering process, as needed. The sheet so processed is ejected onto a storage tray 27 located downstream. The image forming system may be, for example, a copier, a printer or a printing machine. The image forming apparatus A, folding process apparatus B and post-process apparatus C will be described below in detail.

[Image Forming Device]

As illustrated in FIG. 1, the image forming device A includes an image forming unit A1, an image reading unit A2 and a document feeding unit A3. The image forming unit A1 has, in a device housing 1, a sheet feeding part 2, an image forming part 3, a sheet discharge part 4 and a data processing part 5.

The sheet feeding part 2 includes a plurality of cassettes 2*a*, 2*b*, 2*c* and 2*d*. The cassettes 2*a*, 2*b*, 2*c* and 2*d* can individually store therein sheets S of different standard sizes selected ahead of time, respectively. Each of the cassettes 2*a*, 2*b*, 2*c*, and 2*d* incorporates a separating mechanism for separating the sheets S therein one from another and a sheet feeding mechanism for delivering the sheet S. The thus configured sheet feeding part 2 delivers the sheet S of a size specified by a main body control part (not illustrated) to a sheet feeding path 6. In the sheet feeding path 6, a conveying roller 7 and a resist roller 8 are provided. The conveying roller 7 is disposed at the intermediate portion of the sheet feeding path 6 and configured to convey downstream the sheet S supplied from the plurality of cassettes 2*a*, 2*b*, 2*c* and 2*d*. The resist roller 8 is disposed at the end portion of the sheet feeding path 6 and is configured to align the sheets S at their leading ends. The sheets S aligned at their leading ends by the resist roller 8 is fed to the image forming part 3 on the downstream side at a predetermined timing.

The image forming part 3 may be configured at least to form an image on the sheet S fed from the sheet feeding part 2, and various image forming mechanisms can be adopted as the image forming part 3. In the illustrated embodiment, an electrostatic type image forming mechanism is exemplified as the image forming part 3. However, the image forming part 3 is not limited to such an electrostatic type image forming mechanism as illustrated, but an inkjet type image forming mechanism, an offset type image forming mechanism and the like can be adopted as the image forming part 3.

The image forming part 3 illustrated in FIG. 1 is provided with a photoreceptor 9 (drum, belt) and a light emitter 10 that emits optical beam to the photoreceptor 9, and a developer 11 and a cleaner (not illustrated) are disposed around the rotating photoreceptor 9. The illustrated example is a monochrome print mechanism, wherein a latent image is optically formed on the photoreceptor 9 by the light emitter 10, and toner ink is applied to the latent image by the developer 11. The ink image (ink toner) applied onto the photoreceptor 9 is image-transferred, by a transfer charger 12, onto the sheet S fed from the sheet feeding part 2, and the image-transferred sheet S is subjected to image-fixing by a fixing roller 13. The resultant sheet S is fed to a sheet discharge path 14. Further, a circulation path 17 is provided in the image forming part 3, wherein the sheet S from the sheet discharge path 14 is turned upside down in a switch-back path and is fed once again to the resist roller 8, then subjected to image formation on the back surface, and fed to the sheet discharge path 14. The sheet discharge path 14 has a sheet discharge roller 15, and a sheet discharge port 16 is formed at the end thereof. The image-formed sheet S is conveyed by the sheet discharge roller 15 to the folding device B through the sheet discharge port 16.

The image reading unit A2 is provided above the thus configured image forming unit A1. The image reading unit A2 is configured to optically read a document image formed in the image forming part 3. Further, the document feeding unit A3 is mounted on the image reading unit A2.

The image reading unit A2 includes first and second platens 18 and 19 each made of a transparent glass, a reading carriage 20, a light source mounted on the reading carriage 20, a photoelectric conversion element 21 and a reduction optical system 22 constituted by combining a mirror and a lens. In the image reading unit A2, the image on the document sheet S placed on the first platen 18 is irradiated with light from the light source while the reading carriage 20 is moved along the first platen 18, and reflected light from the image on the document sheet S is guided by the reduction optical system 22 to the photoelectric conversion element 21, whereby the image on the document sheet S is read. The photoelectric conversion element 21 converts read image data into an electric signal and transfers the obtained electric signal to the image forming part 3.

The document feeding unit A3 includes a sheet feeding tray 23, a sheet feeding path 24 and a sheet discharge tray 25. In the document feeding unit A3, documents placed on the sheet feeding tray 23 are fed one by one along the sheet feeding path 24, made to pass on the second platen 19, and discharged to the sheet discharge tray 25. When the document fed from the sheet feeding tray 23 and passing on the second platen 19 is read, the reading carriage 20 is stopped ahead of time below the second platen 19, and image data is generated from the image passing on the second platen 19.

[Post-Processing Device]

The post-processing device C is connected to the downstream side of the folding device B connected to the image forming device A and is configured to receive the sheet S (that has been subjected to folding processing or has not been subjected thereto) from the folding device B and apply stapling processing and aligning processing as needed.

A post-processing path 26 is provided inside the post-processing device C, and post-processing units (not illustrated) such as a stapling unit and an aligning unit are disposed along the post-processing path 26. The post-processing device C receives the sheet S discharged from the image forming device A through the folding device B, applies, as needed, stapling processing and aligning processing to the received sheet S by the post-processing units such as the stapling unit and the aligning unit, and discharges the resultant sheet S to the storage tray 27 for storage.

[Folding Device]

The folding device B connected to the image forming device A is configured to receive the image-formed sheet S discharged from the sheet discharge port 16 of the image forming device A and apply folding processing to the sheet S.

Figure 2:
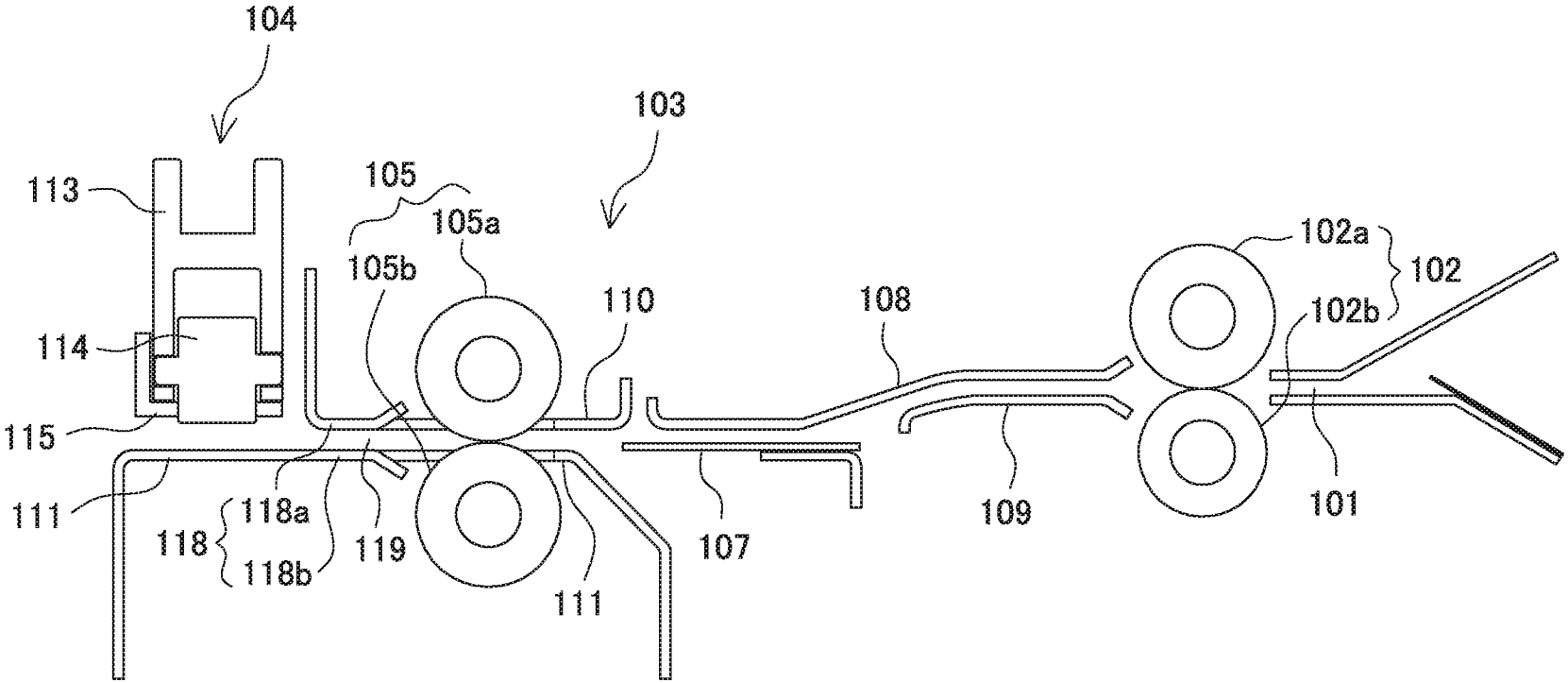
FIG. 2 is diagram illustrating the major components of the folding process mechanism and the additional-folding unit (equivalent to a sheet pressing apparatus) in a folding process apparatus shown in FIG. 1.

FIG. 2 illustrates the internal configuration of the folding process apparatus B. The folding process apparatus B incorporates a transport path 101 that extends in almost horizontal direction. On the transport path 101, one or more transporting-roller pairs 102 and a folding process mechanism 103 are provided. The folding process mechanism 103 is arranged downstream from the transporting-roller pairs 102. Further, an additional-folding unit 104 equivalent to a sheet pressing apparatus of this invention is provided at the end of the downstream transport path 101 of the folding process mechanism 103. In the folding process apparatus B, the folding process mechanism 103 folds the sheet S being transported in the transport path 101, and the additional-folding unit 104 performs the additional folding process on the sheet S. Then, the sheet S can be transferred to the post-process apparatus C.

As illustrated in FIG. 1, the conveying path 101 is disposed so as to be connected to the sheet discharge port 16 of the image forming device A, whereby the sheet S discharged from the sheet discharge port 16 can be carried in the folding device B through the conveying path 101. A discharge port of the additional folding unit 104 is also connected to the post-processing path 26 of the post-processing device C, whereby the sheet S discharged from the additional folding unit 104 can be carried in the post-processing device C through the post-processing path 26.

The conveying roller pair 102 is formed of a rubber roller and includes an upper conveying roller 102*a* disposed on the upper side and a lower conveying roller 102*b* disposed on the lower side so as to be opposed to the upper conveying roller 102*a*. In the present embodiment, the upper conveying roller 102*a* is connected to a not-shown conveying roller drive motor, so as to be rotated with the rotation of the conveying roller drive motor. On the other hand, the lower conveying roller 102*b* is brought into press-contact with the upper conveying roller 102*a* by biasing force of a not-shown spring, so as to follow the rotation of the upper conveying roller 102*a*. However, the conveying roller pair 102 is not limited to the above-described configuration and may have any appropriate configuration as long as it can convey the sheet S.

The folding mechanism 103 is constituted of a folding roller pair 105 and a push plate 107. The folding roller pair 105 is formed of a rubber roller and includes an upper folding roller 105*a* disposed on the upper side and a lower folding roller 105*b* disposed on the lower side so as to be opposed to the upper folding roller 105*a*. The lower folding roller 105*b* is brought into press-contact with the upper folding roller 105*a* by biasing force of a not-shown spring. The upper folding roller 105*a* and the lower folding roller 105*b* are connected in common to a not-shown folding roller drive motor and are rotated in the mutually opposite directions with the rotation of the folding roller drive motor. The push plate 107 is disposed between the conveying roller pair 102 and the folding roller pair 105 and is connected to a not-shown push plate drive motor. The push plate 107 is configured to be moved in parallel to the conveying path on the upstream side of the folding roller pair 105 with the driving of the push plate drive motor.

In the conveying path 101 between the conveying roller pair 102 and the folding roller pair 105, an upper conveying guide 108, a lower conveying guide 109, an upper folding guide 110 and a lower folding guide 111 are provided.

The upper conveying guide 108 is formed so as to extend from a location immediately downstream of the conveying roller pair 102 to a location above the push plate 107 so as to guide the leading end of the sheet S from the conveying roller pair 102 to the push plate 107. The upper conveying guide 108 regulates the direction of the flow of the sheet S conveyed in the conveying path 101. The upper conveying guide 108 is disposed above the conveying path 101 and has a shape bent downward toward the downstream side. The upper folding guide 110 is disposed between the upper conveying guide 108 and the folding roller pair 105 and extends to a location immediately upstream of the folding roller pair 105 so as to guide the leading end of the sheet S and a folded part (to be described later) of the sheet S to the folding roller pair 105. The upper folding guide 110 regulates the direction of the flow of the sheet S in the folding mechanism 103 and is disposed above the conveying path 101 on the downstream side of the upper conveying guide 108.

The lower conveying guide 109 regulates the direction of the flow of the sheet S conveyed in the conveying path 101. The lower conveying guide 109 is disposed below the conveying path 101 and has a shape bent downward toward the downstream side like the upper conveying guide 108. The lower conveying guide 109 is terminated in front of the push plate 107, so that a vacant space is formed on the downstream side of the lower conveying guide 109. The lower folding guide 111 is disposed downstream of the push plate 107 and extends over the upstream and downstream sides of the folding roller pair 105. A part of the lower folding guide 111 on the upstream side relative to the folding roller pair 105 has a horizontal surface for guiding the leading end of the conveyed sheet S and a folded part (to be described later) of the sheet S to a nip of the folding roller pair 105 and an inclined surface for easily guiding the leading end and the folded part of the sheet S to the horizontal surface.

The pushing plate 107 can be moved horizontally by a pushing-plate driving device (not shown) controlled by the control section. The pushing plate 107 is arranged, filling up the space between the lower transport guide 109 and the lower folding guide 111 when the transporting-roller pairs 102 transport the sheet S in the transport path 101 to the folding-roller pair 105. Therefore, the pushing plate 107 can guide the front edge of the sheet S to the lower folding guide 111. When the control section determines that the front edge of the sheet S is nipped the folding-roller pair 105, it moves the pushing plate 107 in the horizontal direction to the retreat position below the lower transport guide 109. So moved, the pushing plate 107 bends the sheet and provides a loop forming space between the lower transport guide 109 and the lower folding guide 111. After the loop forming space is so provided, the sheet S is transported by a prescribed distance, with its front edge nipped by the folding-roller pair 105. Then, the middle part of the sheet S warps downward in the loop forming space, forming a loop. In this state, the pushing plate 107 is moved in horizontal direction, from the retreat position to the folding-roller pair 105, forming a bent portion of the sheet S. After the pushing plate 107 reaches a position in front of the folding-roller pair 105, the folding-roller pair 105 is driven, transporting the sheet S further, thereby forming a folding line on the sheet S.

Figure 3:
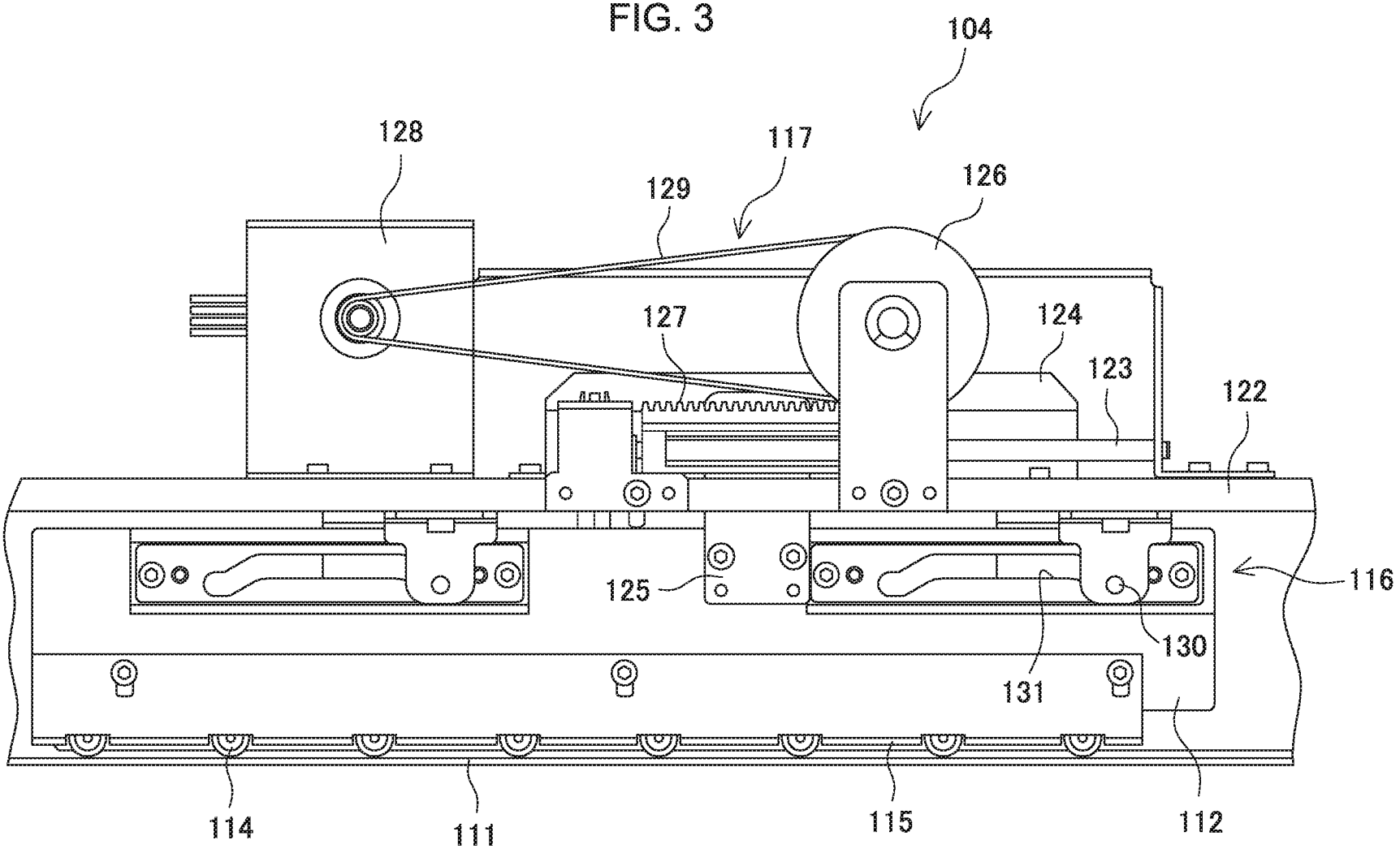
FIG. 3 is a diagram showing the additional-folding unit of the sheet folding apparatus in FIG. 1, as viewed from the sheet outlet port.

With reference to FIG. 3, the configuration of the additional-folding unit 104 will be described. The additional-folding unit 104 is arranged downstream from the folding-roller pair 105 and above the lower folding guide 111. The additional-folding unit 104 comprises a support member 112, a plurality of additional-folding rollers 114, a restriction member 115, a first drive mechanism 116, and a second drive mechanism 117. The support member 112 can move, and supports the additional-folding rollers 114. The restriction member 115 is secured to the support member 112. The first drive mechanism 116 moves the support member 112 in two directions, toward and away from the lower folding guide 111. The drive mechanism 117 moves the support member 112 in the horizontal direction, along the folding line of the sheet S. Those parts of the upper and lower folding guides 110 and 111 arranged one above the other and opposing each other, which lie upstream from the folding-roller pair 105, function as a pair of transport guides 118 for guiding the sheet S into the additional-folding unit 104. The upstream ends of the transport guides 118 define the inlet port 119 of the additional-folding unit 104. The additional-folding rollers 114 supported by the support member 112 and the lower folding guide 111 constitute an additional-folding section.

The additional-folding rollers 114 are supported on the support member 112 and spaced equally from one another, and can rotate around an axis that extends in the direction of transporting each sheet S (namely, in the direction parallel to the upper surface of the lower folding guide 111 and perpendicular to the folding line of the sheet S). The additional-folding rollers 114 have such a length that the space between the two additional-folding rollers 114 arranged at the end positions can cover the entire folding line of the sheet S transported to the additional-folding unit 104 through the inlet port 119. The first drive mechanism 116 moves the support member 112 supporting the additional-folding rollers 114, toward or away from the lower folding guide 111. The additional-folding rollers 114 are thereby moved to and away from the lower folding guide 111. The folding line of the sheet S held between the additional-folding rollers 114 and the lower folding guide 111 can therefore be moved between a pressing position at which the additional-folding rollers 114 and the lower folding guide 111 press the folded part and a retreat position to which the additional-folding rollers 114 are moved away from the sheet S. The second drive mechanism 117 can move the support member 112 in the horizontal direction (i.e., left-right direction in FIG. 3) at the pressing position, thereby moving the additional-folding rollers 114 along the folding line. The additional-folding rollers 114 and the lower folding guide 111 can directly contact unless the sheet S is interposed between them at the pressing position.

Figure 4A:
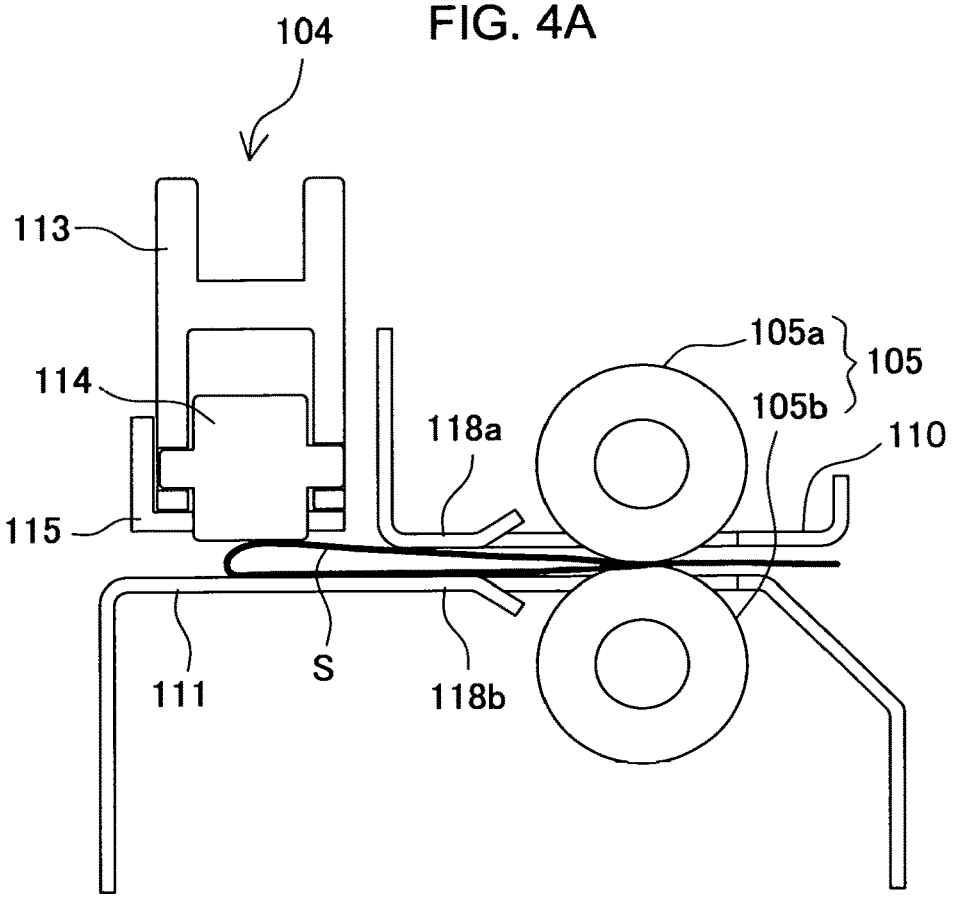
FIGS. 4A and 4B are schematic diagrams explaining how additional-folding rollers are driven to fold a sheet.
Figure 4B:
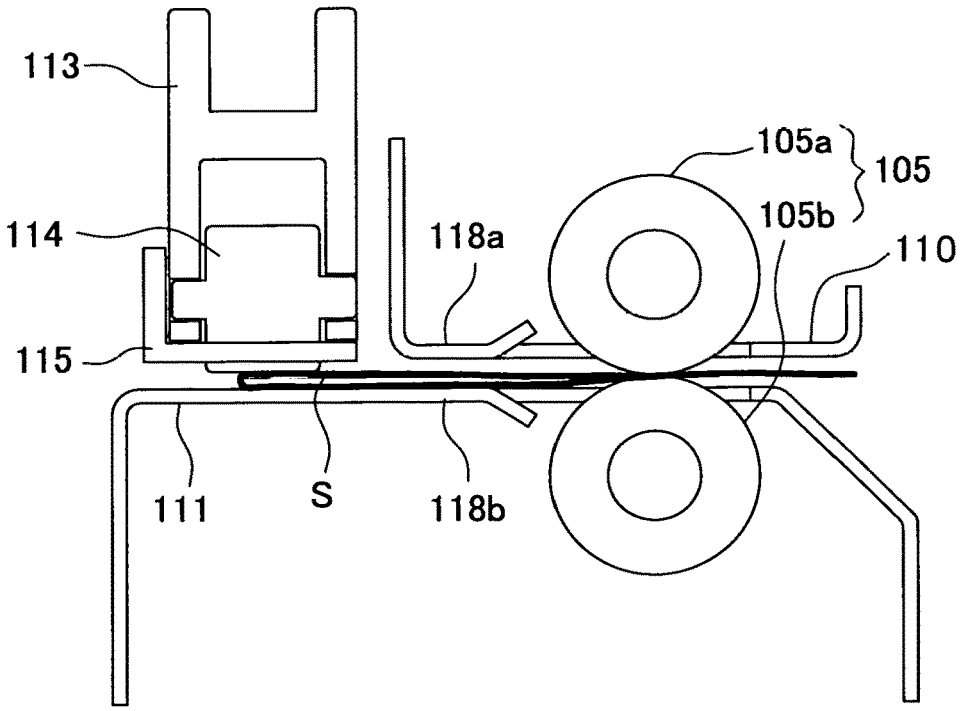

As shown in FIG. 4A, the sheet S is received into the additional-folding unit 104 while the additional-folding rollers 114 remain at a sheet-receiving position far from the pressing position with respect to the lower folding guide 11. Thereafter, the sheet-position detecting means (not shown) arranged downstream from the folding-roller pair 105 detects the position of the sheet S, determining that the folding line of the sheet S has reached a position below the additional-folding rollers 114. Then, the sheet S is stopped. Further, as shown in FIG. 4B, the first drive mechanism 116 moves the additional-folding rollers 114 to a pressing position with respect to the lower folding guide 111, and the second drive mechanism 117 moves the additional-folding rollers 114 to the pressing position with respect to the lower folding guide 111. Further, the second drive mechanism 117 moves the additional-folding rollers 114 along the folding line of the sheet S, with respect to the lower folding guide 111. Therefore, the additional-folding rollers 114 press the sheet at the folding line, performing an additional folding, strengthening the sheet S at the folding line. That is, the additional-folding rollers 114 and the lower folding guide 111 function as pressing members.

The restriction member 115 secured to the support member 112 and having an L-shaped cross section is arranged outside and between the additional-folding rollers 114 which are provided at both extreme ends, adjacent to each other and spaced from each other. In the region where the restriction member 15 is provided, the restriction member 115 can cover the entire folding line of the sheet S transported to the additional-folding unit 104 through the inlet port 119. In the additional folding process, i.e., process of moving the additional-folding rollers 114 along the folding line of the sheet S while the rollers 114 are pressing the lower folding guide 111, the restriction member 115 is positioned a restriction position. While the restriction member 115 remains at the restriction position, the distance d1 between its bottom (i.e., the surface opposing the lower folding guide 111) and the upper surface of the lower folding guide 111 is shorter than the distance d2 (the regular height of the transport path) between the transport guides 118 (i.e., upper transport guide 118*a* and lower transport guide 118*b*) that constitute a transport path connected to, for example, the inlet port 119 of the additional-folding unit 104. The restriction member 115 moves along the folding line of the sheet S, together with the support member 112, while keeping the distance d1. The distance d1 between the bottom of the restriction member 115 and the upper surface of the lower folding guide 111 is so preset that the restriction member 115 and lower folding guide 111 would not directly contact. Therefore, the additional-folding rollers 114 can press the sheet S at the folding line, achieving the additional folding, while the folding line is located lower than the nip of the upper transport guide 118*a* and lower transport guide 118*b*. Further, it is possible to absorb the change of the thickness of the folded part of the sheet S.

The gap between the additional-folding rollers 114 and the lower folding guide 111 and the gap between the restriction member 115 and the lower folding guide 111 are kept constant in the direction parallel to the folding line of the sheet S.

Figure 5:
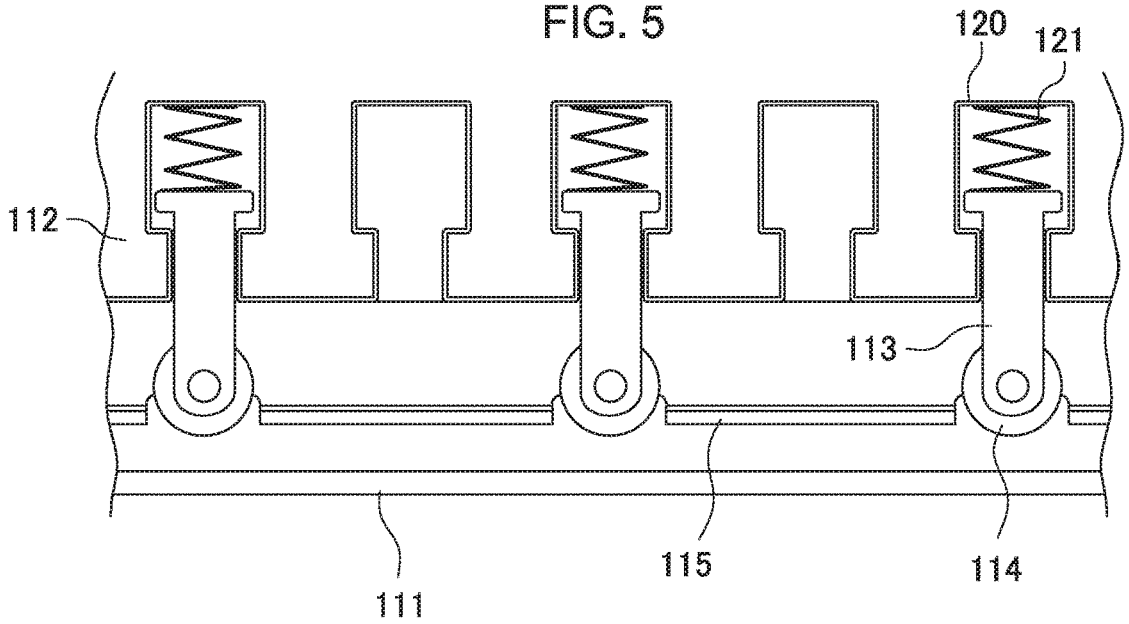
FIG. 5 is a diagram explaining the mechanism provided in the additional-folding unit of FIG. 3 and configured to bias additional-folding rollers to the sheet.

As shown in FIG. 5, the additional-folding roller 114 are secured, respectively, to auxiliary members 113 which are supported by support members 112 and which can rotate with respect to the support member 112. It is desirable that a spring 121 should be arranged between the spring supporting part 120 formed in the support member 112 and the upper end of the auxiliary member 113 to bias the additional-folding roller 114 toward the lower folding guide 111. Therefore, the spring 121 is so arranged, and the additional-folding rollers 114 can stop moving downward when they contact, through the sheet S, the lower folding guide 111, while the support member 112 of the additional-folding unit 104 and the restriction member 115 secured to the support member 112 are moving downwards, and on the other hand, the support member 112 and restriction member 115 can still keep moving downward due to contraction of the spring 121, and can stop at the point of time when the bottom of the restriction member 115 and the upper surface of the lower folding guide 111 face each other at a prescribed distance and hence the restriction member 115 has reached the restriction position. If each auxiliary member 113 is biased by the spring 121, each additional-folding roller 114 can apply a pressure to the folding line of the sheet S even if the support member 112 inclines a little and moves along the folding line. This prevents the pressing force from changing at the folding line, and ultimately suppresses a non-uniform additional folding.

The first drive mechanism 116 and the second drive mechanism 117, both illustrated in the drawing, will be described, in detail, in terms of configuration.

The support member 112 of the additional-folding unit 104 is secured by a bracket 125 to a slider 124 that can move on a guide rail 123 secured to the housing 122 of the folding process apparatus B. The support member 112 can move up and down in horizontal direction, together with the slider 124. On the slider 124, a rack 127 is provided. The rack 127 meshes with a pinion (not shown) which rotates together with the pulley 126. An additional-folding motor 128 is driven, and its drive force is transmitted by a belt 129 to the pulley 126, thereby rotating the pulley 126. The slider 124 can therefore be moved along the guide rail 123 in the horizontal direction.

The support member 112 has a cam groove 131 which receives a contact 130 secured to, for example, the housing 122 of the folding process apparatus B. As the support member 112 moves in the horizontal direction, the contact 130 moves in the cam groove 131. The support member 112 is guided and moves in a manner following the shape of the cam groove 131. The cam groove 131 has a first horizontal bottom part, a first inclining part, a top horizontal part, a second inclining part, and a second horizontal bottom part. The first horizontal bottom part extends almost in the horizontal direction. The first inclining part inclines upward from the end of the first horizontal bottom part. The top horizontal part extends from the end of the first inclining part almost in the horizontal direction. The second inclining part inclines downward from the end of the top horizontal part. The second horizontal bottom part extends almost in the horizontal direction from the end of the second inclining part. The slider 124 may move the support member 112 in the horizontal direction to the housing 122 as shown in FIG. 3, while the first inclining part and the second inclining part of the cam groove 131 are engaged with the contact 130. Thus, the support member 112 can move up or down, toward or away from the lower folding guide 111. The guide rail 123, slider 124, bracket 125, pulley 126, rack 127, additional-folding motor 128, belt 129, contact 130 and the first and second inclining parts of the cam groove 131 constitute the first drive mechanism 116. While the contact 130 remains in the top horizontal part of the cam groove 131, the slider 124 may move the support member 112 in the horizontal direction with respect to the housing 122. The support member 112 and the additional-folding rollers 114, all supported by the support member 112, are thereby moved in the horizontal direction (FIG. 3) with respect to the lower folding guide 111, along the folding line of the sheet S. Thus, the guide rail 123, slider 124, bracket 125, pulley 126, rack 127, additional-folding motor 128, belt 129, contact 130, and the top horizontal part of cam groove 131 constitute the second drive mechanism 117. In the embodiment illustrated, the contact 130 is secured to the housing 122 and the cam groove 131 is made in the support member 112. Needless to say, the contact 130 may instead be secured to the support member 112 and the cam groove 131 may be made in the housing 122.

Figure 6:
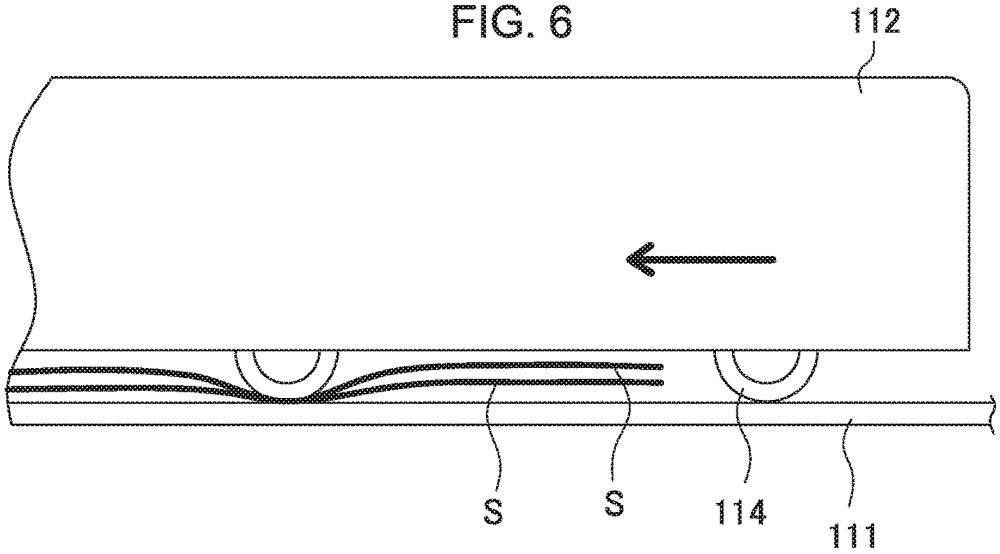
FIG. 6 is a diagram explaining how the additional folding is performed if no restriction members are provided.
Figure 7:
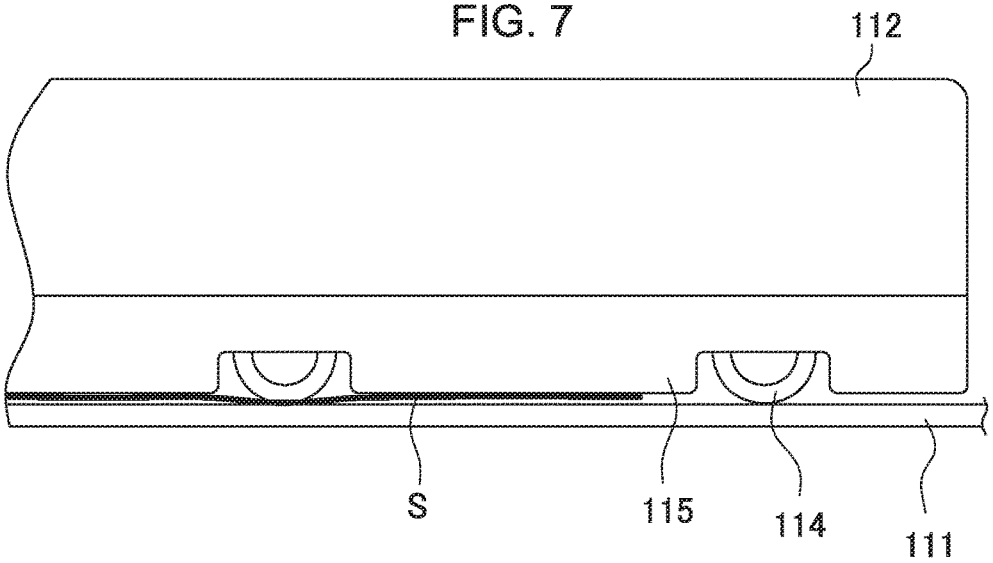
FIG. 7 is a diagram explaining how the additional-folding unit of FIG. 3 having a restriction member performs an additional folding process.

In order to move the additional-folding rollers 114 to the pressing position and then to move them along the folding line of the sheet S, thereby to perform the additional folding, it is necessary to set the front edge of the sheet S between the adjacent additional-folding rollers 114 and to move the support member 112 along the folding line, thereby to mount the additional-folding rollers 114 (not arranged at the folding line of the sheet S) onto the folding line (i.e., the upstream end of the sheet as viewed in the sheet transporting direction). As FIG. 6 shows, the restriction member 115 may not be used, unlike in the additional-folding unit 104 equivalent to a sheet pressing apparatus of this invention. In this case, the sheet part between the parts front and rear with respect to the folding line, may warp, floating from the lower folding guide 111. Those parts of the sheet S, respectively at the ends of the folding line, are bent as the sheet S is pressed by the additional-folding rollers 114, and may move up. Consequently, when the additional-folding rollers 114 press the sheet S at the folding line, they may interfere with the front edge of the sheet S (i.e., edge upstream in the sheet transporting direction), and may damage the sheet. In the additional-folding unit 104 of the sheet pressing apparatus, however, a restriction member is provided outside the additional-folding rollers or between the additional-folding rollers 114 arranged adjacent to one another and spaced apart from one another. Hence, when the additional-folding rollers 114 move toward the lower folding guide 111 along the folding line of the sheet S at the pressing position as shown in FIG. 7, they restrict the thickness of the folded part of the sheet S to a preset value or a smaller value. The sheet therefore floats only a little, at the end parts of the folding line. Therefore, the additional-folding rollers 114 do not damage the sheet S when they contact the front part of the sheet (i.e., upstream end in the sheet transporting direction).

Figure 8A:
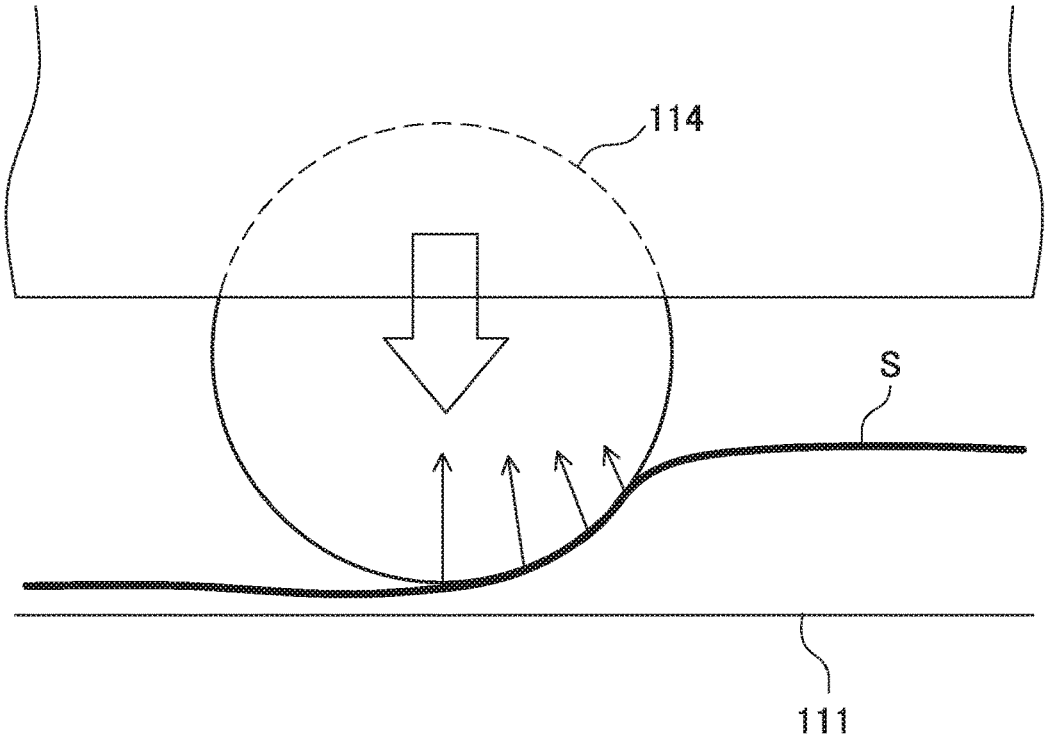
FIGS. 8A and 8B are diagrams explaining the advantages of the restriction member.
Figure 8B:
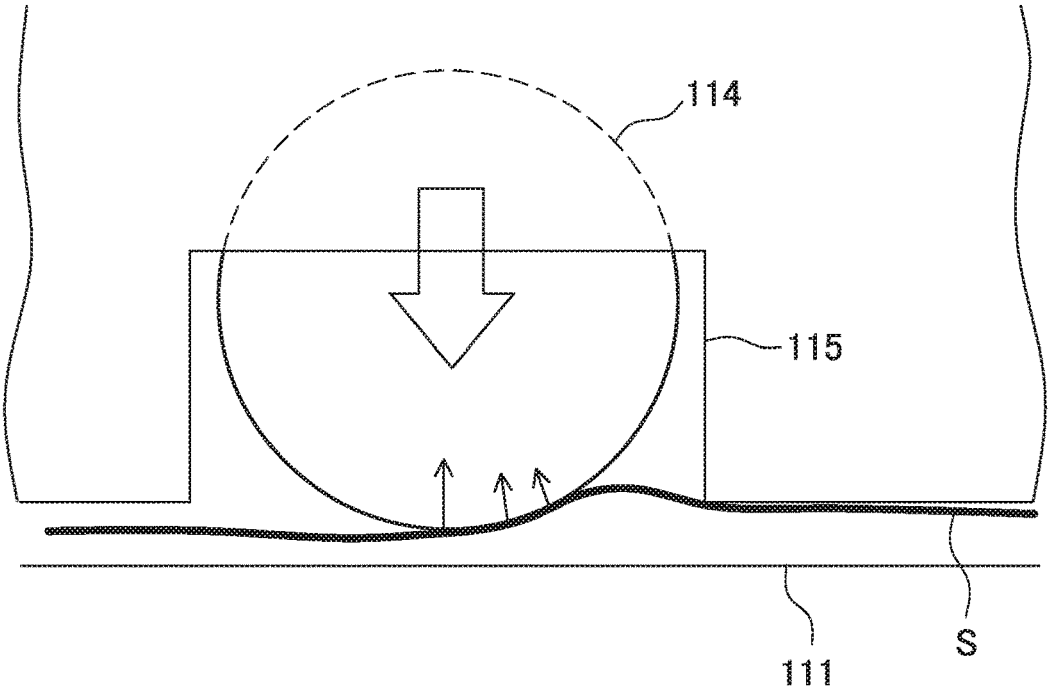

The folding-roller pair 105 may insufficiently fold the sheet and no external force may be applied to the sheet halves, the angle between the sheet halves may be large. In this case, the upper and lower sheet halves are greatly spaced apart, the upper half floating from the lower half. In this case, as shown in FIG. 8A, the reaction of the sheet S to the additional-folding rollers 114 increases, and the pressure that the additional-folding rollers 114 apply to the folding line of the sheet S is canceled out, in part, and becomes lower. However, the additional-folding unit 104 has the restriction member 115. The restriction member 115 restricts the thickness of that part of the sheet S which lies between the adjacent additional-folding rollers 114 or the thickness of those parts of the sheet S, yet to be pressed by the rollers 114, which lie at the ends of the folding line, both to values equal to, or smaller than, a predetermined value. Therefore, as seen from FIG. 8B, the reaction the additional-folding rollers 114 apply to the folding line of the sheet S is less cancelled out, and the pressure is efficiently applied to the folding line of the sheet S, ultimately folding the sheet S firmly. The restriction member 115 may be so arranged that the distance d1 between the bottom of the restriction member 115 at the restriction position (i.e., the surface opposing the lower folding guide 111) and the upper surface of the lower folding guide 111 may be shorter than the distance d2 between the upper transport guide 118*a* and lower transport guide 118*b* that extend from the inlet port 119. Then, during additional folding, the thickness of the folding-line part of the sheet S can be restricted to a value smaller than the thickness the sheet S has in the transport path, and hence, the above effect can be more easily obtained.

While the additional-folding rollers 114 remain at the sheet-receiving position, the distance d3 between the bottom of the restriction member 115 and the upper surface of the lower folding guide 111 is increased longer than the distance d1 between the bottom of the restriction member 115 and the upper surface of the lower folding guide 111 at the restriction position, particularly longer than the distance d2 between the upper transport guide 118*a* and lower transport guide 118*b* extending from the inlet port 119. Then, the restriction member 115 can function as a guide, too.

With reference to FIGS. 9A to 9D, how the additional-folding unit 104 operates will be explained in detail.

Figure 9A:
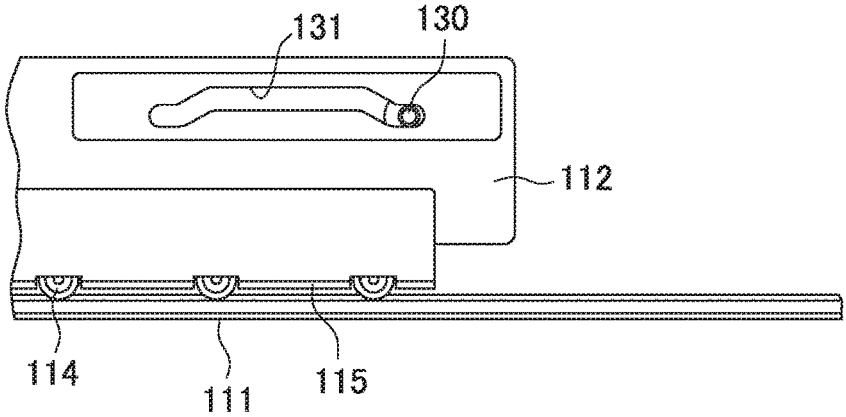
FIGS. 9A to 9D are diagrams explaining how the additional-folding unit operates, FIG. 9A showing the additional-folding rollers arranged at a sheet-receiving position, FIG. 9B showing the additional-folding rollers arranged at a pressing position, FIG. 9C showing the additional-folding rollers moving along the folding line of the sheet, and FIG. 9D showing the additional-folding rollers moved to a retreat position.

The sheet S coming from the folding process mechanism 103 is transported into the additional-folding unit 104 through the inlet path constituted by the inlet port 119, upper transport guide 118*a* and lower transport guide 118*b*. At this time, as shown in FIG. 9A, the additional-folding rollers 114 supported by the support member 112 are at the sheet-receiving position. Then, the lower ends of the additional-folding rollers 114 supported by the support member 112 define the upper side of the transport path, and the lower folding guide 111 defines the lower side of the transport path. The additional-folding rollers 114 and the lower folding guide 111 therefore function as a guide for guiding the folding line of the sheet S to a position between the additional-folding rollers 114 and the lower folding guide 111. At this time, the contact 130 is located at one end of the first horizontal bottom of the cam groove 131.

Figure 9B:
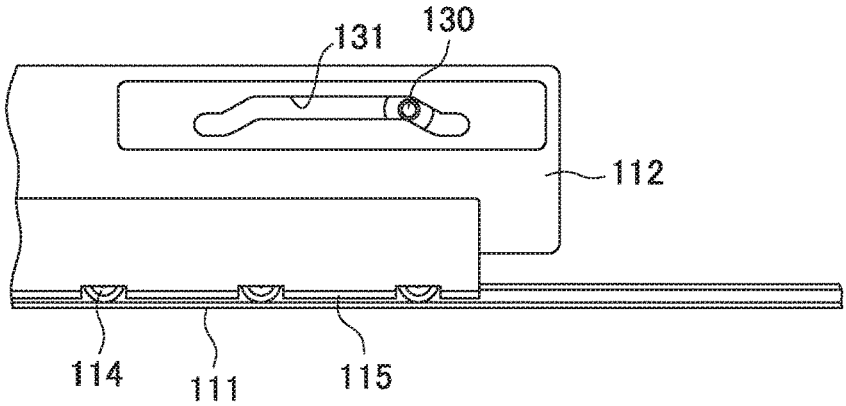

The sheet-position detecting means (not shown) provided upstream from the folding-roller pair 105 detects the position of the sheet S, determining that the folding line of the sheet S transported from the folding-roller pair 105 to the inlet port 119 has reached a position below the additional-folding rollers 114. Then, the transportation of the sheet S is stopped, and the additional-folding motor 128 is driven. The pulley 126 is therefore rotated, and the rack 127 and the pinion are driven, moving the support member 112 together with the slider 124 in the horizontal direction. The contact 130 set in the cam groove 131 therefore moves from the first bottom horizontal bottom part to the first inclining part. As the contact 130 so moves, the support member 112 moves down toward the lower folding guide 111. Then, as shown in FIG. 9B, the additional-folding rollers 114 supported by the support member 112 move to the pressing position. At this time, the end of the folding line of the sheet S (i.e., upstream in the direction of moving the additional-folding rollers 114) is positioned between the two adjacent additional-folding rollers 114 arranged, respectively, at the ends of the folding line of the sheet S, so that the additional-folding rollers 114 may press the sheet S along the entire folding line thereof (see FIG. 6B). Since the auxiliary members 113 secured to the additional-folding rollers 114 are biased by the spring 121 onto the lower folding guide 111, the support member 112 moves down, making the additional-folding rollers 114 abut on the lower folding guide 111 through the sheet S. Even after the additional-folding rollers 114 abut on the lower folding guide 111, the support member 112 can move down. As the support member 112 moves down, the restriction member 115 moves down, pressing the sheet S along the folding line, at a position below the additional-folding rollers 114. The restriction member 115 therefore restricts the thickness of the sheet S, at the folding line, to a value smaller than a prescribed value. The term "sheet transporting direction" used herein means the direction in which the sheet S is transported into the additional-folding unit 104 through the inlet port 119.

Figure 9C:
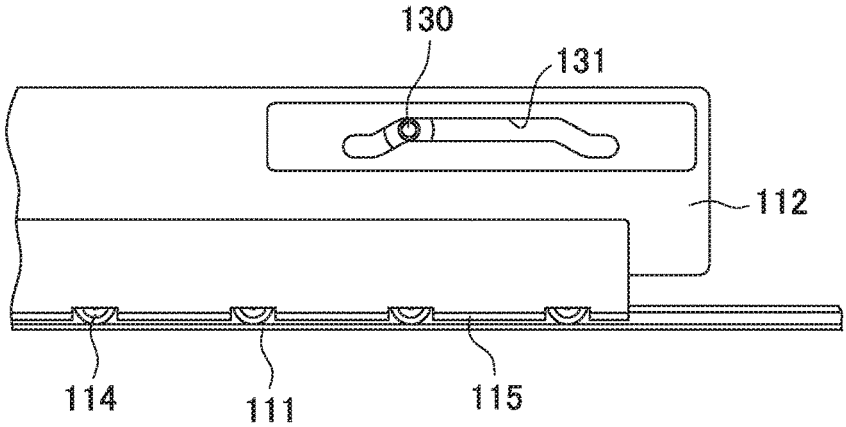

In the state shown in FIG. 9B, the additional-folding motor 128 may be driven, and the support member 112 may thereby be moved in the horizontal direction together with the slider 124. Then, as shown in FIG. 9C, the contact 130 moves in the cam groove 131, from the first inclining part of the cam groove 131 to the top horizontal part of the cam groove 131. Then, the restriction member 115 secured to the support member 112 restricts the thickness at the folding line of the sheet S to a preset value (equivalent to distance d1), and the additional-folding rollers 114 supported by the support member 112 move to the lower folding guide 111 along the folding line of the sheet S. Thus, the additional-folding rollers 114 and the lower folding guide 111 press the sheet S at the folding line, making the folding line more firm, namely accomplishing the additional folding.

At this time, the sheet S at the folding line has a thickness equal to or less than the value preset by the restriction member 115. This prevents the sheet S from being damaged at the folding line when the additional-folding rollers 114 move in the horizontal direction along the folding line of the sheet S and some of the additional-folding rollers 114, not on the folding line, ride then on the folding line of the sheet S. Further, since the restriction member 115 restricts the thickness of the sheet S at the folding line, the reaction from the folding line is smaller than otherwise. The pressing force of the additional-folding rollers 114 is therefore efficiently transmitted, more strengthening the sheet than otherwise at the folding line. Moreover, since the additional-folding rollers 114 are biased, each by a spring 121, they can each apply a uniform pressing force to the folding line of the sheet S, even in case the support member 112 is inclined along the folding line of the sheet S.

Figure 9D:
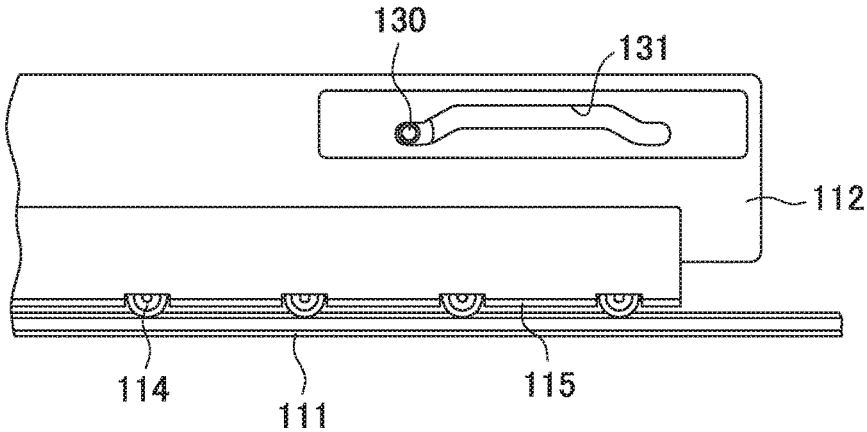

In the state shown in FIG. 9C, the additional-folding motor 128 is driven, moving the support member 112 in the horizontal direction, together with the slider 124. Then, the contact 130 engaged in the cam groove 131 moves from the top horizontal part of the cam to the second inclining part of the cam and then to the second horizontal bottom part of the cam. As shown in FIG. 9D, the support member 112 moves up, together with the restriction member 115, away from the lower folding guide 111. At the same time, the additional-folding rollers 114 supported by the support member 112 move to the retreat position. The additional folding process is thereby completed. The sheet S additionally folded is ejected into the post-process path 26 of the post-process apparatus C. The retreat position may be identical to, or different from, the sheet-receiving position. The lower ends of the additional-folding rollers 114 and the bottom of the restriction member 115, once moved to the retreat position, function as guides for ejecting the sheet S which has been additionally folded.

If the sheet S has two or more folding lines, as if Z-folded or double-folded, the transport of the sheet S is stopped every time the folding line of the sheet S is arranged between the additional-folding rollers 114, on one hand and, the lower folding guide 111, on the other. The additional-folding rollers 114 are then moved along the folding line of the sheet S, thereby performing the additional folding.

A single sheet or a sheet bundle may be folded. The sheet bundle may either be a bundled or not bundled.

A sheet pressing apparatus according to this invention and an image forming system using the apparatus have been described with reference to the embodiments illustrated in the drawing. The invention is not limited to the embodiments, nevertheless. In the embodiment described above, the first drive mechanism 116 is composed of guide rail 123, slider 124, bracket 125, pulley 126, rack 127, additional-folding motor 128, belt 129, contact 130, and first and second inclining parts of the cam groove 131, and the second drive mechanism 117 is composed of guide rail 123, slider 124, bracket 125, pulley 126, rack 127, additional-folding motor 128, belt 129, contact 130, and top horizontal part of the cam 131. If the support member 112 can move toward and away from the lower folding guide 111 and can move along the folding line of the sheet S, the configurations of the first drive mechanism 116 and second drive mechanism 117 are not limited; they may be, for example, linearly moving mechanisms. Further, in the embodiment described above, the additional-folding rollers 114 are driven and moved with respect to the lower folding guide 111. Instead, the lower folding guide 111 may be moved, approaching the additional-folding rollers 114. Both the additional-folding rollers 114 and the lower folding guide 111 may, of course, be moved. In order to move the lower folding guide 111, a lift mechanism may be used. Further, the additional-folding rollers 114 may be replaced by a spring that biases the lower folding guide 111 toward the additional-folding rollers 114.

What is claimed is:

1. A sheet pressing apparatus designed to perform an additional folding on a sheet already folded and having a folding line, and comprising:

an inlet port configured to receive a sheet having a folding line made in a folding process and transported in a prescribed transport direction;

a first pressing member arranged downstream of the inlet port, as viewed in the transport direction, and configured to press the sheet at the folding line;

a second pressing member arranged, opposing the first pressing member, and configured to cooperate with the first pressing member to press the sheet at the folding line;

a first drive mechanism configured to move the first pressing member between a pressing position and a retreat position, thereby to cause the first pressing member to approach the second pressing member and, at the pressing position, to press the sheet at the folding line arranged between the first pressing member and the second pressing member, and to cause the first pressing member, at the retreat position, to move away from the sheet with respect to the second pressing member;

a second drive mechanism configured to move the first pressing member along the folding line with respect to the second pressing member, after the first drive mechanism moves the first pressing member to the pressing position with respect to the second pressing member; and a restriction member configured to restrict, at a preset restriction position, the sheet thickness at the folding line to a value equal to or less than a prescribe value when the second drive mechanism starts moving the first pressing member along the folding line at the pressing position with respect to the second pressing member.

2. The sheet pressing apparatus according to claim 1, further comprising a pair of transport guides arranged upstream from the restriction member in the transport direction, spaced apart by a first distance, opposing each other, and configured to restrict the position of the sheet in the sheet thickness direction, and the restriction member at the restriction position is at a second distance equal to or shorter than the first distance in the sheet thickness direction.

3. The sheet pressing apparatus according to claim 2, wherein when the sheet is transported toward the nip between the first and second pressing members through the pair of transport guides, the restriction member is arranged at a sheet-receiving position spaced from the second pressing member in the sheet thickness direction by a third distance longer than the second distance and restricts the sheet thickness at the folding line.

4. The sheet pressing apparatus according to claim 1, further comprising a biasing member configured to bias at least one of the first and second pressing members toward the folding line.

5. The sheet pressing apparatus according to claim 4, further comprising a support member, the support member supports a plurality of first pressing members spaced apart from one another, a plurality of biasing members are provided, each for one first pressing member, and each biasing member biases the associated first pressing member toward the folding line.

6. The sheet pressing apparatus according to claim 1, wherein the first drive mechanism moves the restriction member together with the first pressing member.

7. The sheet pressing apparatus according to claim 6, wherein the second drive mechanism drives the restriction member moved to the restriction position by the first drive mechanism, along the folding line together with the first pressing member.

8. The sheet pressing apparatus according to claim 1, wherein the restriction member is arranged to restrict, at the restriction position, before moving the first pressing member along the folding line, that part of the sheet which is upstream of the folding line in the direction the first pressing member moves.

9. An image forming system comprising:

an image forming apparatus configured to form an image on a sheet;

a sheet processing apparatus configured to perform a fold on the sheet delivered from the image forming apparatus; and a sheet pressing apparatus according to claim 1.

* * * * *